United States Patent [19]

Sumner et al.

[11] Patent Number: 4,665,686

[45] Date of Patent: May 19, 1987

[54] SYSTEM FOR MANAGING DOFFING OF STRAND PROCESSING MACHINES

[75] Inventors: C. Thom Sumner, Charlotte, N.C.; John E. Lane, Littleton, Mass.

[73] Assignee: Parks-Cramer Company, Fitchburg, Mass.

[21] Appl. No.: 787,648

[22] Filed: Oct. 16, 1985

[51] Int. Cl.[4] ..... D01H 13/14

[52] U.S. Cl. ..... 57/264; 57/265

[58] Field of Search ..... 57/264, 265, 266, 276, 57/277, 278, 267, 268, 81

[56] References Cited

U.S. PATENT DOCUMENTS

| | | | |
|---|---|---|---|
| 3,809,869 | 5/1974 | Gebald | 364/470 |
| 4,194,349 | 3/1980 | Lane | 57/276 X |
| 4,563,873 | 1/1986 | Tooka | 57/276 X |

*Primary Examiner*—Donald Watkins

*Attorney, Agent, or Firm*—Bell, Seltzer, Park & Gibson

[57] ABSTRACT

The doff management system of the present invention employs a central computer unit communicating with each yarn processing machine in a textile mill and operating under program control for monitoring and governing the operation of various functions and aspects of the mill operation. The system monitors strand production at each machine and whether the production has reached a predetermined criteria required for doffing; producing schedules of the machines which will be ready for doffing within a forthcoming time period; with the capability of altering the doffing schedules necessary to distribute workload; handling assignment of available doffers to frames which are ready for doffing; tracking earnings of doffers; and monitoring and recording various changes in the production status of the machines and generating current, historical, and prospective reports concerning the textile mill operations.

17 Claims, 6 Drawing Figures

SYSTEM FOR MANAGING DOFFING OF STRAND PROCESSING MACHINES

FIELD AND BACKGROUND OF THE INVENTION

This invention relates to an improvement in the operation of strand production machines, such as ring spinning frames.

During the operation of such machines, raw material is converted into continuous strands, such as yarns, and wound up on bobbins or tubes to form packages. The packages are designed to hold a predetermined nominal quantity (by weight or length) of the strand material. When a full package is formed on the machine, the full package is removed from the machine or "doffed" and replaced by an empty tube or bobbin. Although machines have been produced for automating the doffing function on certain strand production machines, it is more common for the doffing function to be carried out by an operator conventionally referred to as a "doffer".

The conventional procedure for doffing the strand processing machines, which has been employed for many years, may be characterized as "cycle doffing". In cycle doffing, each doffer is assigned a group of machines, for example eight machines. The machines are doffed in cycles, with the doff cycle for each machine running a predetermined period of time. The doffer will doff each machine a certain number of times during each shift, depending upon the length of the doff cycle. Ideally, the doff cycles of the respective machines for which the doffer is responsible are staggered so that by the time the doffer has completed one machine, another machine is approaching readiness for doffing. However in actual practice, the doff cycles may not be evenly distributed, and there may thus result periods during which the doffer has idle time. Also, because of uneven distribution of the cycles, there may occur "short doffs" in which a machine is doffed before the packages are filled to the optimum desired amount. Also, under some circumstances, a machine may be ready for doffing while the doffer is still busy tending to another machine, which may result in producing a larger than standard package, which is undesirable, or if the machine is stopped, in nonproductive standing time while the machine awaits a doffer. It will be seen that the above circumstances result in inefficiences in the use of available manpower and in the utilization of the production equipment.

In an effort to overcome some of the disadvantages and limitations of the aforementioned cycle doffing procedure, it has been proposed to employ a procedure whereby the doffers are not permanently assigned to specified frames, but instead are assigned to a particular frame as the doffer becomes available and a frame becomes ready for doffing. Applicants are aware of at least a couple of instances in textile mills in which this approach has been implemented by using a type of mechanical linkage or switch on the frame, usually on the builder motion, for sensing when the doffing cycle is completed and signalling a computer which makes the frame assignment to the doffer. However, the capabilities of these systems were fairly restricted and did not involve significant frame monitoring functions or data gathering and reporting capabilities, nor did the systems actually exert control over the operation of the frames themselves.

It is an object of the present invention to overcome the aforementioned disadvantages and deficiencies of the conventional "cycle doffing" approach, and to make optimum and most efficient use of available manpower and production equipment resources through the use of an improved "random doffing" approach in which available manpower is dispatched on a priority basis to the individual strand production machines which most require attention. It is a further object of the invention to provide a doff management system in which the production status of each machine is monitored and altered if needed, and changes in production status are recorded to permit producing various historical reports concerning the textile mill operation and its efficiency.

SUMMARY OF THE INVENTION

The doff management system of the present invention employs sensors on each strand processing machine for sensing various aspects of the production status, and a central processing unit or computer communicating with the sensors on the various machines and operating under program control to monitor and govern the operation of a number of functions and aspects of the operation of the textile mill.

Among the functions which are provided by the present invention are (a) monitoring the strand production at each machine and whether the production has achieved a predetermined criteria required for doffing;

(b) producing schedules of the machines which will be ready for doffing within a forthcoming time period;

(c) handling assignment of available doffers to frames which are ready for doffing in accordance with predetermined doff priority criteria;

(d) tracking the earnings of doffers paid on a per-doff basis or other basis and displaying the accumulated earnings to the doffer on demand; and (e) monitoring and recording various changes in the production status of the machines and generating current, historical and prospective reports concerning the textile mill operations.

BRIEF DESCRIPTION OF THE DRAWINGS

Additional features and functional capabilities of the doff management system of the present invention will become apparent from the detailed description and claims which follow, and from the accompanying drawings, in which

DETAILED DESCRIPTION OF THE INVENTION

While the present invention will be described hereinafter with particular reference to the accompanying drawings, it is to be understood at the outset that persons skilled in the arts applicable to the present invention will be enabled by this disclosure to construct apparatus and to practice methods which embody the present invention and yet take forms which may differ from those here particularly described and shown. Accordingly, the description which follows is to be understood broadly as an enabling disclosure directed to persons skilled in the appropriate arts, and is not to be taken as being restrictive upon the scope of the present invention.

Figure 1:
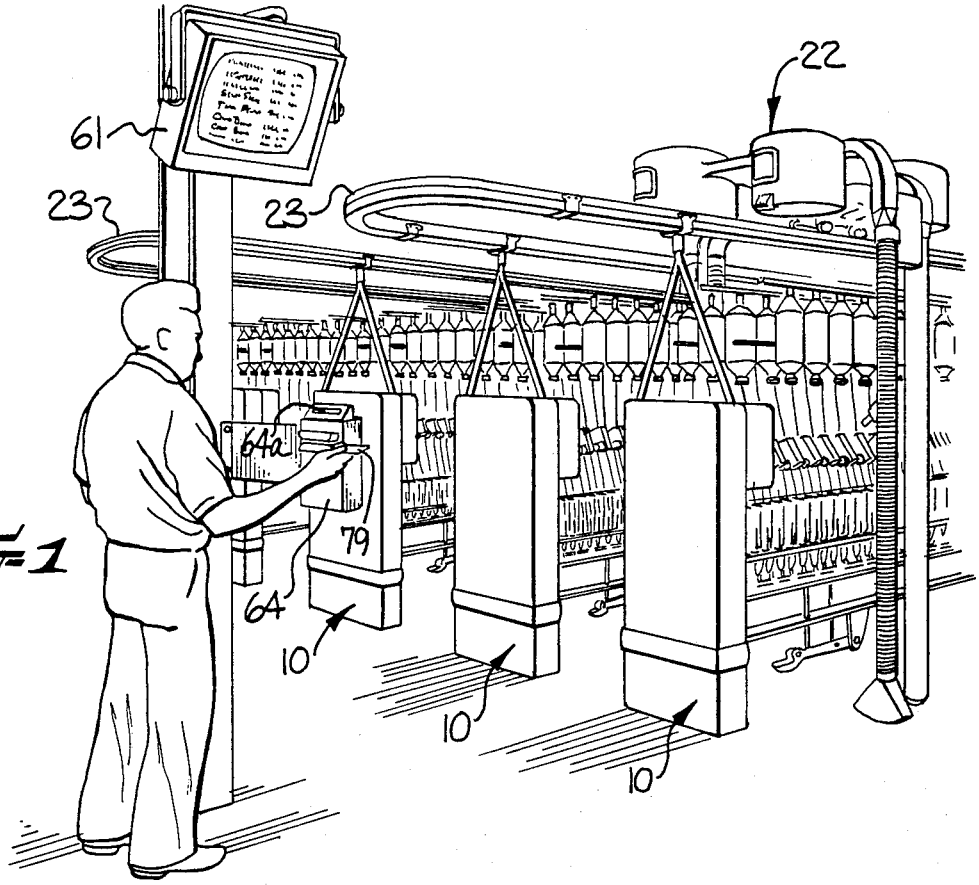
FIG. 1 is a perspective view of a textile mill incorporating an installation of apparatus in accordance with the present invention.
Figure 2:
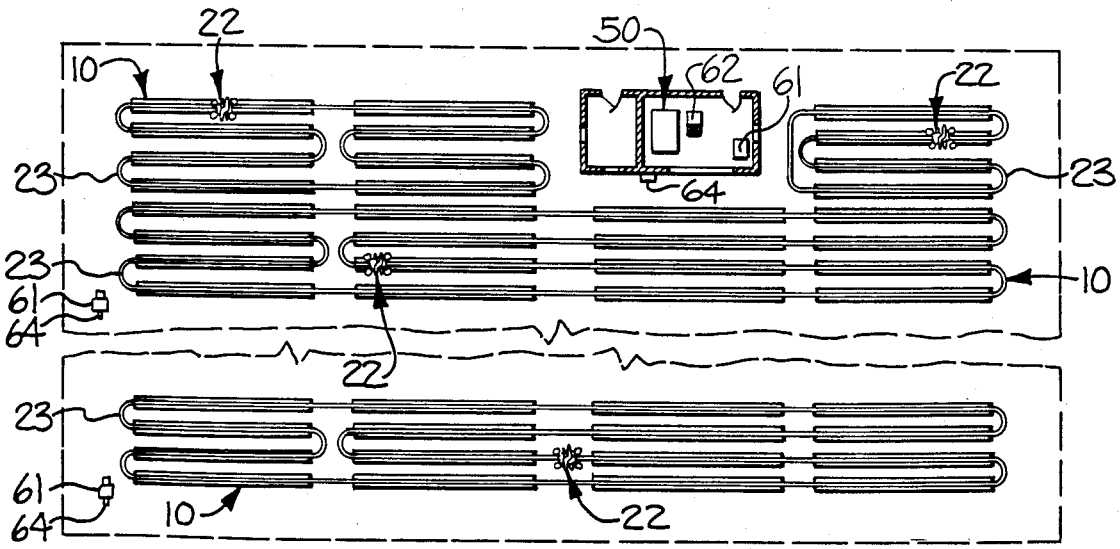
FIG. 2 is a schematic plan view of a textile mill similar to that of FIG. 1, illustrating the arrangement of a number of ring spinning machines in the mill.

While the present invention is contemplated as being useful in connection with various types of textile yarn processing machines, the invention is illustrated and described herein in connection with a plurality of ring spinning machines, certain of which are indicated generally at 10 in FIG. 1, arranged in a series of rows in a textile mill. One typical arrangement is schematically illustrated in FIG. 2, where the spinning frames 10 are arranged end to end in a series of rows, with aisles or alleys between adjacent rows to permit servicing of the machines by attendants. In a textile mill employing ring spinning machines of the type illustrated herein, the attendants normally include "spinners" who are responsible for maintaining control of the spinning frames, periodically patrolling each frame alley, replacing empty roving bobbins, and piecing up broken ends; and "doffers" who are responsible for removing or "doffing" the full yarn bobbins from a spinning frame, replacing the spindles with empty bobbins, and restarting the spinning frame.

Figure 3:
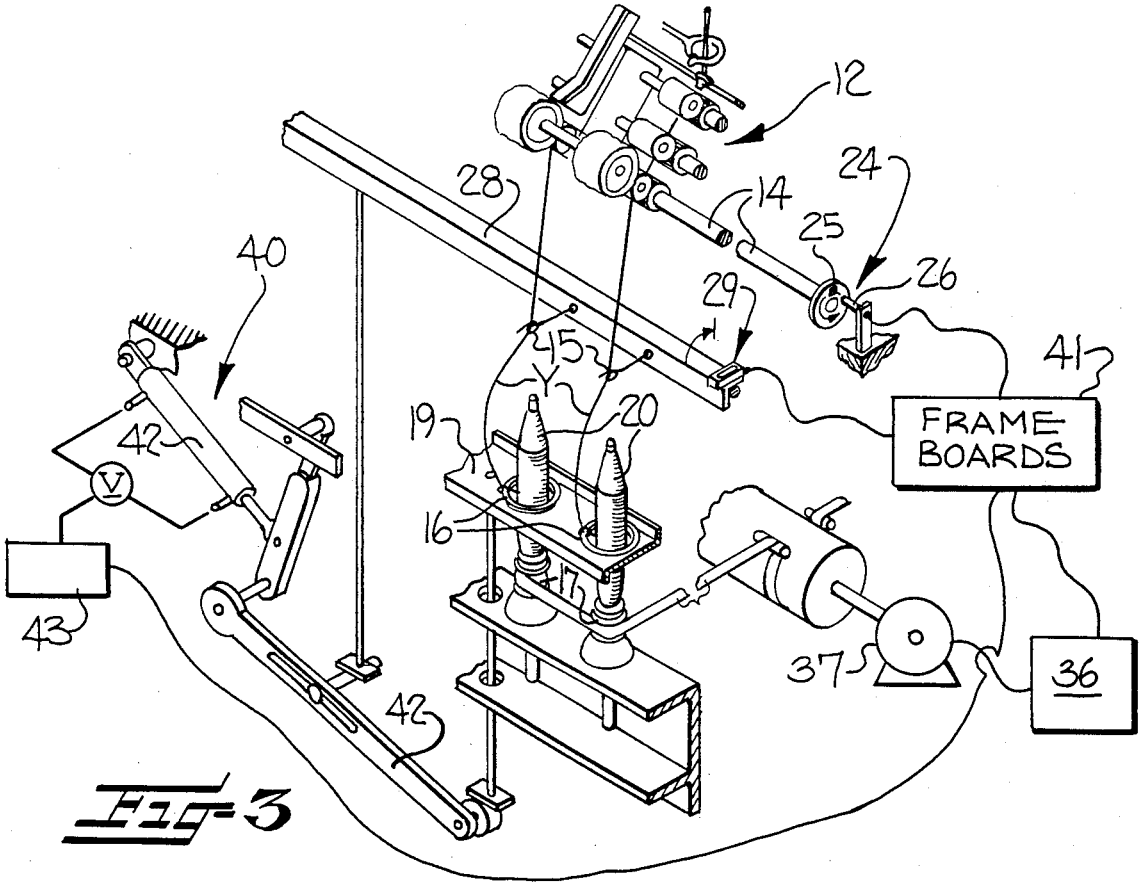
FIG. 3 is a fragmentary schematic perspective view of certain components of one of the ring spinning machines shown in FIG. 1.

Each of the ring spinning machines includes elements for receiving raw material in the form of a fibrous strand known as roving, drawing or attenuating the roving, and twisting the attenuated roving to form yarn. The operating instrumentalities of a ring spinning machine are well known to persons skilled in the applicable textile arts, and are therefore not described in detail herein. In summary, as shown in FIG. 3, the elements include a drafting zone 12 where the strand material is drawn and attenuated, a front or delivery roll 14 where the attenuated yarn Y is delivered, intermediate guides 15 or "pigtails" through which the yarn passes, and rings 16 encircling spindles 17 and about which travelers move in twisting or spinning ends of yarn and winding them onto the bobbins. The rings 16 are mounted in ring rails 19 which move vertically relative to the spindles 17 as the yarn is wound thereon to build a yarn package 20.

In commonly-owned and related U.S. Pat. Nos. 3,523,413; 4,194,349; 4,294,066; and 4,294,065 there is disclosed a system for monitoring certain operating conditions of the spinning frames in a textile mill, displaying information concerning the operating conditions at strategic locations within the mill, and utilizing the information to assist spinners in locating and piecing up ends down and to thereby improve the efficiency of operation of the machines. As described more fully in the aforementioned patents, and as shown schematically herein, one or more traveling units 22 (FIGS. 1 and 2) is arranged for traversing the textile machines along predetermined paths of travel defined by overhead rails 23 in order to monitor and detect the condition of the ends of yarn normally being formed, to determine whether any of the ends are broken, and upon detection of a broken end, to interrupt the feed of roving to the drafting zone. In addition, data concerning the ends down condition of the spinning machine is collected and transmitted to a central processing unit where the ends down information can be displayed or printed to facilitate more efficient operation of the machine and allocation of the spinners for piecing up the ends down.

Also as described in aforementioned U.S. Pat. Nos. 4,194,349, 4,294,065, and 4,294,066, each spinning frame is equipped with certain sensors for signaling certain operating characteristics of the machines. Referring more particularly to the sensor means, and to FIG. 3, one sensor means takes the form of a suitable electrical device and associated components which together function as a rotation sensor means 24 for generating of electrical pulse signals at a frequency proportional to the revolutions of the delivery rolls 14 from which strand material issues. In the embodiment illustrated, a magnet 25 is connected to the delivery roll 14 so as to rotate therewith. The interconnection may be direct or indirect through gearing by which the rolls are driven. The magnetic proximity detector 25, such as a Hall effect device 26 which is responsive to variations in the magnetic field, is mounted adjacent to the roll 14 so as to sense each time the magnet passes by and for generating a train of electrical pulse signals. Persons skilled in the appropriate arts will recognize that other specific forms of rotation sensor means 24 may be employed. From the signal produced by the front roll sensor means 24, the number of revolutions of the front roll 14 can be determined, and hence it is possible to monitor the quantity of yarn produced at a given spindle. This information, coupled with data concerning the number of ends down and the number of spindles on each side of the frame, provides an indication of the amount of yarn produced on each side of the frame. Additionally, by comparing the cumulative number of revolutions of roll 14 during a given doff cycle and comparing this to a standard count for the number of revolutions in a complete doff cycle, it is possible to accurately determine at any time the particular status of a frame in its doff cycle.

The pigtail or intermediate guides 15 along the length of a ring spinning machine 10 are mounted on a common mounting rod or bar 28 in order to permit a doffer to readily move all of the guides to a raised, inoperative position during doffing. Suitable means, shown in the form of mercury switch 29, is fixed to the common mounting bar 28 for movement with the intermediate guides and thereby serves as a guide position sensor means for generating an electrical signal upon the movement of the guides from the lowered operative position to the raised inoperative position. When a doffer begins the process of doffing a ring spinning machine and moves the intermediate guides to the raised inoperative position, this occurrence is detected by the sensor 29. While only a single device is shown in FIG. 3, a plurality of sensors 29 may be provided on any ring spinning machine having intermediate guides which are grouped into more than one grouping or area around the machine. Thus, a guide position signal would be generated upon movement of any group of intermediate guides to a position indicative of doffing occurring.

Each spinning machine is equipped with a frame board means 41 (FIG. 3). In the embodiment shown, the frame board means 41 is electrically connected with the rotation sensor means 24, and the guide position sensor means 29. The frame board means 41 incorporates appropriate semiconductor logic circuit means (in forms known to persons skilled in the appropriate arts) for receiving from the sensors 24 and 29 electrical signals indicative of the rotation of the front roll 14 and the position of the intermediate guides 15. Signals regarding the guide position are, in essence, stored or recorded awaiting inquiry as explained more fully hereinafter. Signals indicative of rotation of the delivery rolls 14 are counted, with the numerical count being stored for inquiry as explained more fully hereinafter. The frame board includes a universal asynchronous receiver-transmitter (sometimes referred to as a UART) for communication as described more fully hereinafter.

In addition, in accordance with the present invention each frame is equipped with a motor controller 36 associated with the main drive motor of the spinning frame (indicated at 37) for controlling the stopping or starting of the frame on certain conditions. The motor controller 36 is electrically connected to the frame board 41 for receiving signals transmitted from the central processing unit, when certain conditions have occurred which would require stopping of the frame, such as for example when the doff cycle has been completed and the frame is ready for doffing.

In preparing a spinning frame for doffing, it is necessary to move the ring rail 19 to a retracted, inoperative position where it will be out of the way and free from obstruction when the doffer removes the full bobbins and replaces empty bobbins on the spindles. The lowering of the ring rails in preparation for doffing is commonly referred to in the art as "bearing down". This is commonly accomplished manually by the doffer when he reaches the machine, by actuating a lever or linkage provided for this purpose. However, in some instances spinning frames are equipped with "automatic bear down" devices which will automatically cause the ring rails to be lowered in preparation for doffing. Conventionally, the automatic bear down sequence is triggered mechanically through a linkage associated with the builder motion which controls reciprocation of the ring rail. In FIG. 3, the builder motion is broadly indicated at 40 and may include various mechanical linkages 42 and an associated actuator. In accordance with the present invention and as illustrated in FIG. 3, a bear down actuator device indicated at 43 may be provided in each frame connected to the builder motion 40. The bear down actuator device 43 is electrically connected to the frame board means 41 for receiving a signal from the central processor indicating the need for bearing down the ring rails.

Figure 4:
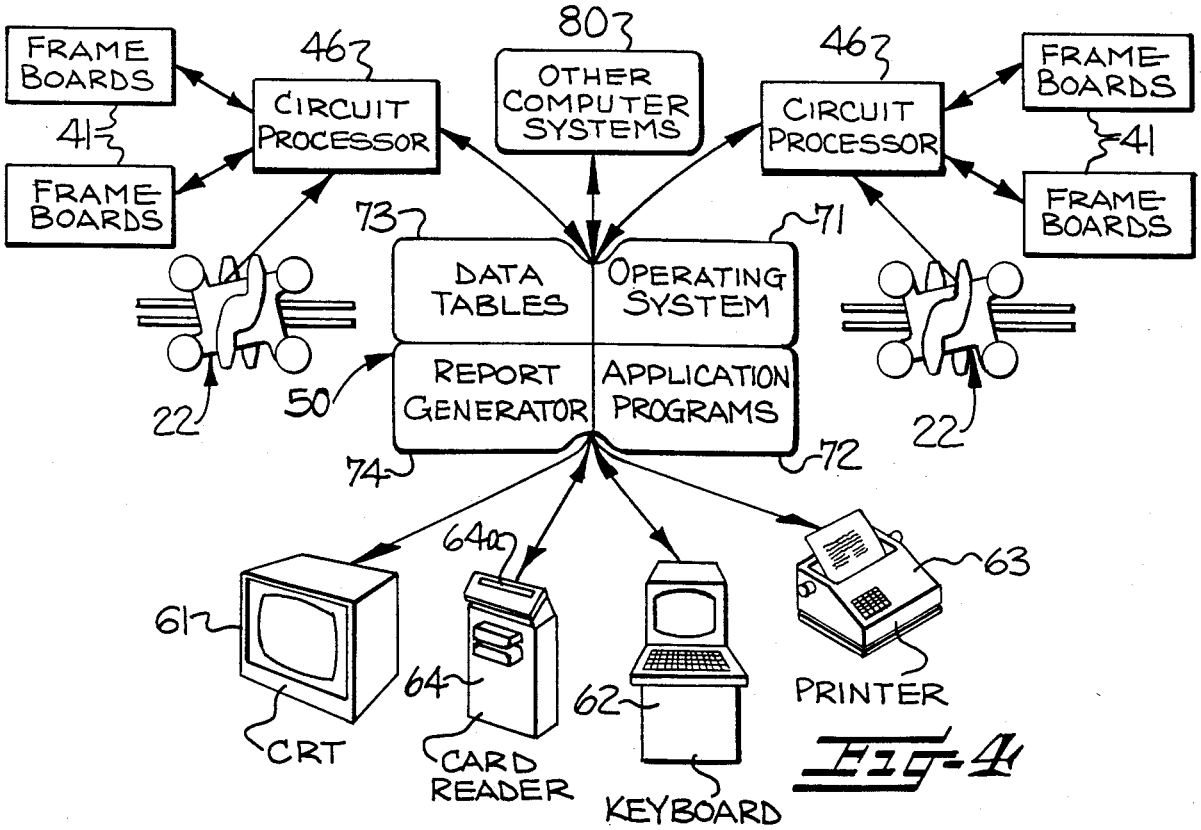
FIG. 4 is a schematic representation illustrating certain components of apparatus in accordance with the present invention and how they are operatively interconnected.

As illustrated in FIG. 4, the frame boards 41 for the respective spinning machines 10 communicate with a corresponding one of a plurality of circuit processor means 46. Each circuit processor means is preferably a microcomputer of a commercially available type, such as Intel system 8010. In a typical textile mill installation having a plurality of ring spinning machines, a plurality of circuit processors 46 are provided, each communicating with a corresponding plurality of frame boards 41 through the use of UARTS. Each circuit processor receives signals not only from the corresponding plurality of frame boards 41 but additionally from portions of the data system carried aboard the traveling units 22, as described more fully in the aforementioned related prior patents incorporated by reference into the present disclosure. The circuit processors receive from the frame boards 41 and traveling units 22 signals indicative of the ring rail positions, roll revolution count, ends down, and ends up. From such data, each circuit processor 46 may compute delivery roll speeds in revolutions per minute, time intervals relative to spinning machine operation, and totaled ends up and down.

A plurality of circuit processor means 46 communicate with a single central or main processing unit 50. The central processor 50 functions primarily as a master for the entire processor system, with the plurality of circuit processors 46 and the plurality of frame boards 41 responding to the central processor 50.

The central processor 50 carries out a number of functions, including those described in the aforementioned commonly-owned U.S. Pat. No. 4,194,349. As is illustrated in FIG. 4, the central processor receives from the plurality of circuit processors 46 signals indicative of certain changes in status of the spinning machine operation, delivery roll speeds, guide position signals, and ends down. The central processor also generates display signals to drive various visual displays, such as the CRT video devices 61 illustrated. In addition, in accordance with the present invention certain significant additional capabilities and functions are provided by the central processor 50 and certain associated sensors and actuators.

In the preferred embodiment illustrated and described herein the central processor 50 takes the form of a commercially available microcomputer having multiprocessing capabilities and equipped with a large capacity non-volatile data storage device, such as a Winchester disk drive for example, for storing large quantities of data relating to the textile mill operations, as well as for storing systems and applications software. As schematically indicated in FIG. 4, the central processor operatively communicates with circuit processors 46, and in turn with frame boards 41 and traveling units 22 as earlier described. Additionally, the central processor is communicatively connected to video display devices such displays 61, at selected locations throughout the textile mill, a console unit 62, typically including a keyboard and video display, for controlling operations of the system, a printer 63, and a input/output device for use by the doffer, such as a magnetic or optical card reader 64 as illustrated.

As is further schematically illustrated in FIG. 4, the central processor 50 includes a suitable commercially available operating system 71 as well as various applications programs 72 for carrying out the various functions and tasks of the monitoring system as described more fully hereinafter. Persons skilled in the appropriate arts are capable of selecting an appropriate commercially available operating systems, and for programming applications programs capable of performing the functions and tasks hereinafter described. Accordingly, it is neither necessary or desirable to include an extensive detailed description of these detailed aspects of applicant's invention. By way of example, one suitable operating system is the XENIX operating system, available from Microsoft Corp. and the applications programs may be written in a suitable programming language such as C, Pascal or Basic.

The use of a standard operating system also makes it possible for the user to write his own programs employing any familiar programming language, in order to make use of the stored information in the data tables.

An important and significant aspect of the invention is the provision of a data table 73 for storing significant information relating to the operations of the textile machines. Depending upon the storage capacity, historical data may be retained for as much as a year or longer. From this data, it is possible to generate current as well as historical reports relating to various aspects of the operations of the textile mill.

To facilitate generation of such reports from the data tables, the central processing unit is provided with report generator means 74, in the form of computer programs capable of producing various standard frequently used reports, as well as user defined reports containing selected fields of information for specific purposes.

Additionally, the central processing unit 50 provides the capability for other computer systems 80 to access the stored data in the data tables, via an RS 232 port or other suitable means. Thus it is possible for example for the mainframe computer of a textile mill to obtain access to the stored data in the data tables and to process this data for any desired purpose.

Figures 5, 6:
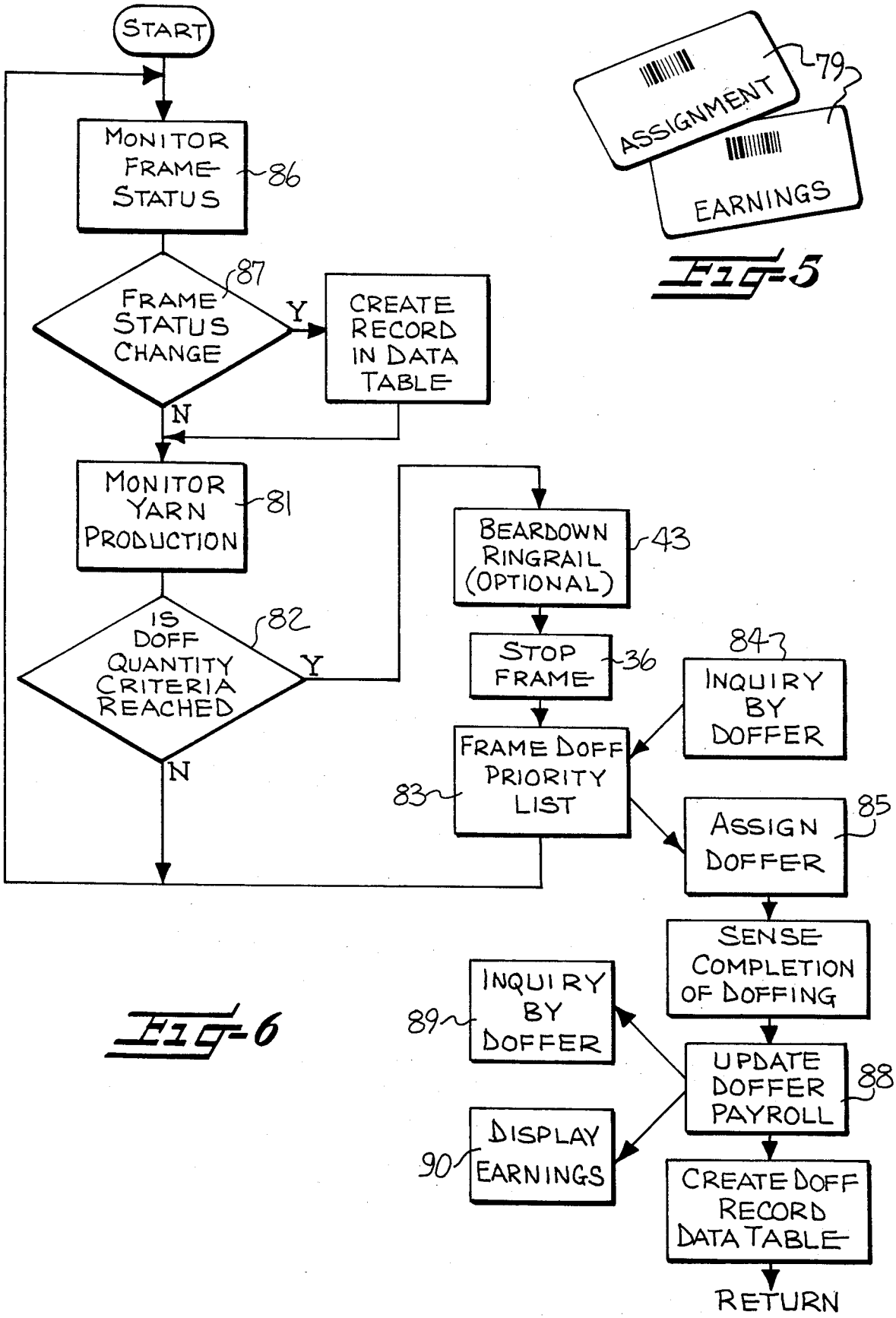
FIG. 5 is a view illustrating both sides of a doffer card which a doffer may use in accordance with the present invention to receive an assignment of a spinning machine for doffing and, to obtain information concerning his earnings.
FIG. 6 is a schematic flow chart depicting the data processing functions in accordance with the present invention.

FIG. 6 schematically illustrates various functions which are achieved by the system of the present invention. In summary, these functions include:

(a) automated frame stop and bear down
(b) frame doff scheduling
(c) doffer assignment
(d) doffer payroll
(e) frame status monitoring and report generation.

One important function of the system is to continuously monitor the yarn production at each machine, and to determine when the machine has produced a full bobbin of yarn, and to thereupon stop the machine and assign a doffer to doff the machine.

Referring to FIG. 6, as indicated at 81, production of each spinning frame is monitored by the roll revolution sensor 24, previously described. Each machine has a preset doff quantity criteria representing the optimum of revolutions in a complete doff cycle. As indicated at 82 in FIG. 6, the current production of each machine is compared to the doff quantity criteria. When the number of roll revolutions on a frame reach the desired doff quantity criteria, information is generated indicating that the frame is ready for doffing. At this time if the frame is equipped with automatic bear down equipment, a command or instruction is directed to the bear down actuator 43 to bear down the ring rail 19 in preparation for doffing. Also at this time a command or instruction is directed to the motor controller 36 for that frame to stop the operation of the frame. This prevents overruns which could cause production of a yarn package larger than of optimum size, which may cause handling problems or in some instances damage the equipment or the yarn package. The fact that the frame is ready for doffing is also noted, and that frame is added to a priority list of frames which are awaiting doffing, indicated at 83 in FIG. 6.

In the conventional operation of a textile mill, each doffer is assigned certain specified frames as his responsibility. Desirably, the doffer keeps these frames on a staggered doff schedule so that he can successively doff each respective frame. However, this approach often results in the doffer stopping the operation of a frame prior to its reaching full capacity, or in some instances allowing the frame to overrun and build an oversize yarn package. The present invention provides for the use of a random doffer assignment system whereby each available doffer is used where most needed for doffing those frames which are ready for doffing. This makes it possible to obtain most effective use of available manpower, to maximize bobbin weights, and to help reduce unproductive machine down, time so as to thereby increase the overall production efficiency of the mill. Additionally, the system can provide payroll calculations for doffers who are paid on a per-doff or other basis.

When a doffer is available and ready to receive an assignment of a frame for doffing, the doffer makes an inquiry (84 in FIG. 6) at a doffer station conveniently located in the spinning room. In the embodiment illustrated, the assignment station is in form of a card reader 64, although it will be apparent that other means may be employed for accomplishing this function. Each doffer is assigned a personal card 79 having a unique identification thereon. (FIG. 5) The identification may comprise an optically readable bar code as illustrated or other suitable means such as magnetic coding or the like. When the doffer passes his card 79 through the reader 64, as shown in FIG. 1, a display **64*a* associated with the card reader 64 assigns to the doffer to the next available frame which is awaiting doffing, based upon a predetermined frame priority system (85 in FIG. 6). The central processor 50 maintains a priority list (83 in FIG. 6) of those frames which are available for doffing, with the priority being based upon preselected criteria which may be specified by the mill. For example, the criteria may involve the length of time that the frame has been idle and awaiting doffing, the particular style of yarn being produced on that frame, the location of the frame relative to the doffer making the request, or a combination of these or other criteria. Once a frame has been assigned to a doffer, this event is recorded in the data tables 73. When the doffer reaches the frame and begins doffing, as sensed by the guide position sensor 29, this event is also noted and recorded in the data table 73**. Similarly, when the doff is completed and the frame is restarted, this event is also recorded.

The system also keeps track of the number of doffs made by a doffer during a given shift or pay period, to thereby provide payroll calculations for each doffer. As indicated at 88 in FIG. 6, when a doff is completed, the doffer's payroll record is updated. As seen in FIG. 5, the reverse side of the doffer card 79 is labeled "earnings" and also bears a unique optically readable code. By passing the card through the reader 64 with the earnings side up, the doffer can make an inquiry 89 and request and obtain display 90 of his cumulative earnings at that time.

Based upon the information which has been accumulated and recorded by the system and in the data tables 73, various kinds of reports can be obtained by the mill supervisor or other personnel. For example, since the system continually monitors the status of each frame in its doff cycle, a doff schedule report may be produced upon request, which provides a chronological listing of all frames which will be ready for doffing within a specified period of time. This allows the supervisor to identify peak doffing periods in sufficient time to take necessary action, such as by obtaining additional doffing help or by modifying doffing schedules. An example of a doff schedule report is reproduced below as Table I.

If the supervisor wishes to modify doffing times in order to make more effective use of available manpower during peak doffing periods, the supervisor may, through the keyboard, specify an override criteria, such as an earlier doffing time or lower bobbin weight for selected frames. When the frame reaches that criteria, it will be stopped and a doffer will be assigned to the frame for doffing as though a full doff cycle had been completed. This ability to look ahead at the doffing schedule and to take corrective action by modifying doffing times enables the supervisor to maximize efficiency and productivity.

An other important function of the present invention is to continuously monitor the operating status of each frame in the spinning mill (86 in FIG. 6). Each time a change in the operating status of a frame occurs, this event is noted (87) and recorded in the data table 73. Examples of changes in the production status include (1) when a frame is started and begins production, (2) when a frame is stopped, (3) when a doffer is assigned to the frame for doffing, (4) when the doffer actually begins doffing, (5) when the doffing is completed and the frame is restarted, and (6) when a frame is taken out of production such as for servicing or due to over capacity. From the data table containing this information it is possible to generate various reports, including information such as the total running time of a given frame or group of frames, total production, percent efficiency in production, time that the machine is awaiting assignment of a doffer, time spent during doffing, number of doffs, etc.

For example, a doff track report similar to that illustrated in Table II below, may be produced which gives a chronological listing of the exact times that frames were doffed over some specified period of time. Frame track reports such as that illustrated in Table III are also available for listing for any particular frame, times that any frame condition change occurred; i.e. doffing, standing, frame temporarily removed from mill operation, etc.

It will be readily appreciated that from the information available in the data table, and the information being currently obtained by the system, various other historical, current, and prospective reports can be produced.

TABLE I

DOFF SCHEDULE REPORT
From Thu Aug 15 11:15 to Thu Aug 25 13:00 1985

| Frame No. | Actual Speed | Standard Speed | Standard Revs | Current Revs | Calculated Doff Time | Modified Doff Time | % of Standard |
|---|---|---|---|---|---|---|---|
| 13 | 161 | 160 | 62131 | 62008 | 11:27 | | 100% |
| 56 | 148 | 160 | 77664 | 74696 | 11:47 | | 100% |
| 1 | 159 | 160 | 62131 | 58928 | 11:47 | | 100% |
| 89 | 159 | 160 | 77664 | 73128 | 11:55 | | 100% |
| 22 | 161 | 160 | 62131 | 55976 | 12:05 | | 100% |
| 57 | 163 | 160 | 77664 | 69520 | 12:16 | | 100% |
| 70 | 160 | 160 | 77664 | 69472 | 12:18 | | 100% |
| 33 | 156 | 160 | 77664 | 67240 | 12:33 | | 100% |
| 4 | 158 | 160 | 62131 | 50472 | 12:40 | | 100% |
| 74 | 159 | 160 | 77664 | 65360 | 12:44 | | 100% |
| 7 | 161 | 160 | 62131 | 49680 | 12:44 | | 100% |
| 61 | 159 | 160 | 77664 | 63880 | 12:53 | | 100% |

TABLE II

DOFF TRACK REPORT
For Wed Aug 7 1985 from 5:45 to 6:40

| Time | Frm | Stat'n | Doffer Number | Doffer Id | E.D. at Doff | Style # | Total Minutes Assign | Wait | Doff | Total lbs. |
|---|---|---|---|---|---|---|---|---|---|---|
| 5:54 | 90 | E | 105 | JOE | 6 | 1 | 9 | 0 | 5 | 68.0 |
| 6:01 | 49 | H | 108 | ED | 2 | 1 | 0 | 26 | 6 | 83.7 |
| 6:06 | 24 | G | 107 | BOB | 0 | 2 | 0 | 5 | 7 | 69.2 |
| 6:07 | 3 | F | 106 | JIM | 12 | 2 | 0 | 1 | 7 | 71.4 |
| 6:15 | 53 | H | 108 | ED | 5 | 1 | 12 | 0 | 7 | 89.7 |
| 6:19 | 6 | F | 106 | JIM | 2 | 2 | 0 | 2 | 5 | 64.0 |
| 6:22 | 57 | G | 107 | BOB | 0 | 1 | 0 | 0 | 11 | 73.5 |
| 6:32 | 67 | E | 105 | JOE | 1 | 1 | 0 | 0 | 6 | 72.1 |
| 6:36 | 9 | F | 106 | JIM | 17 | 2 | 0 | 0 | 8 | 64.5 |
| 6:39 | 59 | G | 107 | BOB | 5 | 1 | 5 | 1 | 10 | 75.4 |

TABLE III

FRAME TRACK REPORT
Frame 35
For Fri Aug 9 1985 from 9:30 to 12:00
Style = 1 31/1 Cotton 2" Ring Lbs./Bob = 250 Revs = 77664
Speed = 165 Spinner I = C, Spinner C = C, Doff Station = L

| Time | Condition | Speed | EDI | EDC | Time Since Change |
|---|---|---|---|---|---|
| 10:30 | SPG | 0:18 | 158 | 0 | 4 | |
| 10:48 | OVR | 0:00 | 158 | 0 | 1 | 93 |
| 11:00 | OVR | 0:12 | 158 | 0 | 1 | |
| 11:04 | WTA | 0:00 | 158 | 0 | 0 | 16 |
| 11:06 | DOF | 0:00 | 158 | 0 | 0 | 2 |
| 11:12 | SPG | 8:06 | 158 | 0 | 0 | 6 |
| 11:30 | SPG | 7:48 | 159 | 1 | 2 | |
| 12:00 | SPG | 7:18 | 160 | 2 | 2 | |

That which is claimed is:

1. In a textile yarn production mill including a plurality of yarn processing machines, each machine having a plurality of yarn production stations for producing wound packages of yarn, each yarn package being adapted to contain a predetermined optimum quantity of yarn thereon, the combination therewith of:

production monitoring means associated with each yarn processing machine for generating a data signal representative of the yarn being produced at the respective machine, and central processing means operatively connected to each yarn processing machine, said central processing means including means responsive to the data signals from each of said production monitoring means for determining the quantity of yarn produced at the respective yarn processing machines, means for storing predetermined doff quantity criteria for each machine, and means for comparing the quantity of yarn produced at a given yarn processing machine with said stored predetermined doff quantity criteria for that machine and for stopping the operation of the machine when said predetermined doff quantity criteria is reached to permit doffing by an attendant, and for generating a signal indicative of the need for doffing at that machine.

2. Apparatus according to claim 1 wherein the yarn processing machines comprise ring spinning machines including ring rails which traverse the yarn packages in winding the yarn onto the packages, and wherein said apparatus also includes means responsive to the yarn production reaching said predetermined doff quantity criteria for moving the ring rails to a retracted inactive position to thereby prepare the machine for doffing by the attendant.

3. Apparatus according to claim 1 wherein said central processing means also includes means for generating a doff priority list, based upon predetermined doff priority criteria, of the yarn processing machines which require doffing by an attendant.

4. Apparatus according to claim 3 wherein said central processing means additionally includes means responsive to an inquiry by an attendant who is available for doffing for assigning to the attendant, from said doff priority list, the next machine which is to be doffed.

5. Apparatus according to claim 4 including means on each of said yarn processing machines for sensing when the machine is restarted upon the completion of doffing, and wherein said central processing means additionally includes means responsive to said sensing of the machine restarting for generating a record crediting the attendant with the doffing of the machine.

6. Apparatus according to claim 1 wherein said central processing means includes means responsive to the data signals from said production monitoring means and to the predetermined doff quantity criteria for the respective machines for generating a schedule of the yarn processing machines which will be ready for doffing during a forthcoming time period.

7. Apparatus according to claim 6 wherein said central processing means additionally includes override means for receiving input of an override doff quantity criteria for a selected machine so as to thereby alter the normal doffing schedule to facilitate distributing the workload of the attendants.

8. Apparatus according to claim 1 wherein said yarn processing machines each include a rotating yarn delivery roll whose peripheral speed corresponds to the rate of production of the yarn, and wherein said production monitoring means comprises means for counting the number of revolutions of said delivery roll.

9. In a textile yarn production mill including a plurality of yarn processing machines, each machine having a plurality of yarn production stations for producing wound packages of yarn, each yarn package being adapted to contain a predetermined optimum quantity of yarn thereon, the combination therewith of:

production monitoring means associated with each yarn processing machine for generating a data signal representative of the yarn being produced at the respective machine, and central processing means operatively connected to each yarn processing machine, said central processing means including means responsive to the data signals from each of said production monitoring means for determining quantity values proportional to the quantity of yarn produced at the respective yarn processing machines, means for storing predetermined doff quantity criteria for each machine representing the quantity of yarn produced in a normal, complete doffing cycle, report generating means operable upon request for comparing said quantity values with said stored predetermined doff quantity criteria and for generating a schedule of the yarn processing machines which will be ready for doffing during a forthcoming time period, and override means for receiving input from an operator of an override doff quantity criteria for a selected machine so as to thereby alter the normal doffing schedule to facilitate distributing the workload of the attendants.

10. In a textile yarn production mill including a plurality of yarn processing machines, each machine having a plurality of yarn production stations for producing wound packages of yarn, each yarn package being designed to contain a predetermined optimum quantity of yarn thereon, the combination therewith of:

production monitoring means associated with each yarn processing machine for generating a data signal representative of the yarn being produced at the respective machine, central processing means operatively connected to each yarn processing machine, said central processing means including means responsive to the data signals from each of said production monitoring means for determining the quantity of yarn produced at the respective yarn processing machines, means for storing predetermined doff quantity criteria for each machine representing the quantity of yarn produced in a normal, complete doffing cycle, and means for comparing the quantity of yarn produced at a given yarn processing machine with said stored predetermined doff quantity criteria for that machine and for generating a signal indicative of the need for doffing at that machine when said predetermined doff quantity criteria is reached, means responsive to said signal for generating a doff priority list, based upon predetermined doff priority criteria, of the yarn processing machines which are awaiting doffing by an attendant, means responsive to an inquiry by an attendant who is available for doffing for assigning to the attendant, from said doff priority list, the next machine which is to be doffed, means responsive to a signal indicating that that yarn processing machine has been restarted for recording that the doffing of said machine has been completed, and for recording and storing a record crediting the attendant with the doffing of that machine.

11. Apparatus according to claim 10 additionally including means responsive to an inquiry by an attendant for displaying to the attendant the accumulated earnings from machines for which he has received credit for doffing.

12. Apparatus according to claim 10 including a plurality of cards, one for each attendant, each card bearing a unique identification for that attendant, and including card reader means located in the textile mill and accessible to the attendants, said card reader means being operatively connected to said central processing means for receiving said inquiry by the attendant when the attendant places his unique identification in the card reader means.

13. Apparatus according to claim 12 additionally including display means associated with said card reader means and operable for displaying to the attendant the next frame assignment for doffing and/or the accumulated earnings for the attendant.

14. Apparatus according to claim 10 additionally including sensor means associated with each yarn processing means for sensing changes in its production status between states of spinning, awaiting doffing, doffing, and out of production; and means operatively communicating with the sensor means at each machine for recording and storing a record of each occurrence of a change in the production status of a machine, together with the machine identification and date and time of each such occurrence.

15. In a textile yarn production mill having a plurality of yarn processing machines, each machine having a plurality of yarn production stations for producing wound packages of yarn, each yarn package being adapted to contain a predetermined optimum quantity of yarn thereon, the combination therewith of:

production monitoring means associated with each yarn processing machine for generating a data signal representative of the yarn being produced at a production station of the respective machine, means for storing predetermined doff quantity criteria for each machine representing a predetermined optimum quantity of yarn to be contained on a yarn package, means responsive to the data signals from said production monitoring means for determining the quantity of yarn produced at the respective machines, means for comparing the quantity of yarn produced with said stored predetermined doffing quantity criteria for that machine and in response to said predetermined criteria being reached, generating a signal indicative of the need for doffing at that machine, means responsive to said signal indicative of the need for doffing at that machine for stopping the operation of the machine, means at each yarn processing machine for sensing when a doffer begins doffing the machine, means for sensing when the yarn processing machine is restarted by the doffer upon the completion of doffing, and means operatively communicating with each yarn processing machine and including magnetic data storage means for recording and storing a record of each occurrence of a change in production status of a machine between the states of spinning, awaiting doffing, doffing and out of production, together with the date, time, and machine identification.

16. Apparatus according to claim 15 including means for generating from said recorded and stored records a report of the changes in production status of the machines for a predetermined time period.

17. In a textile yarn production mill having a plurality of yarn processing machines, each machine having a plurality of yarn production stations for producing wound packages of yarn, each yarn package being adapted to contain a predetermined optimum of quantity of yarn thereon, the combination therewith of:

sensor means associated with each yarn processing means for sensing changes in its production status between the states of spinning, awaiting doffing, doffing and out of production, central processor means operatively communicating with the sensor means at each machine and including magnetic data storage means for recording and storing a record of each occurrence of a change in the production status of a machine, together with the machine identification and date and time of each such occurrence, and means for retrospectively generating from said recorded and stored records a report of the changes in production status of the machines based upon selected criteria.

* * * * *